US009039123B2

(12) United States Patent
Oizumi et al.

(10) Patent No.: US 9,039,123 B2
(45) Date of Patent: May 26, 2015

(54) PRINTING APPARATUS

(71) Applicant: SEIKO EPSON CORPORATION, Tokyo (JP)

(72) Inventors: Takao Oizumi, Nagano (JP); Yohei Nunokawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/225,650

(22) Filed: Mar. 26, 2014

(65) Prior Publication Data

US 2014/0292882 A1 Oct. 2, 2014

(30) Foreign Application Priority Data

Mar. 28, 2013 (JP) ..... 2013-068283

(51) Int. Cl.
*B41J 29/38* (2006.01)
*B41J 13/00* (2006.01)
*B41J 3/60* (2006.01)

(52) U.S. Cl.
CPC ..... *B41J 13/0009* (2013.01); *B41J 3/60* (2013.01)

(58) Field of Classification Search
CPC ..... B41J 13/0009; B41J 3/60
USPC ..... 347/16
See application file for complete search history.

(56) References Cited

U.S. PATENT DOCUMENTS 7,527,346 B2 * 5/2009 Izuchi ..... 347/16
2007/0030299 A1 2/2007 Izuchi

FOREIGN PATENT DOCUMENTS

JP 2007-038562 A 2/2007

* cited by examiner

*Primary Examiner* — Julian Huffman
(74) *Attorney, Agent, or Firm* — Global IP Counselors, LLP

(57) ABSTRACT

A sheet is transported at a first transport speed when a rear edge of the sheet is on a platen during transporting of the sheet to a reversing mechanism according to a sheet returning process after completing printing on a front surface, and the sheet is transported at a second transport speed which is faster than the first transport speed when the rear edge of the sheet passes over the platen until the rear edge of the sheet is nipped by a transport roller. Due to this, it is possible to smoothly transport the sheet without the sheet being caught on the concave and convex section of the platen and it is possible to transport the sheet quickly to the transport roller when the rear edge of the sheet passes the platen.

5 Claims, 6 Drawing Sheets

| | PRINTING QUALITY | | |
|---|---|---|---|
| | FAST | STANDARD | HIGH QUALITY |
| SECOND TRANSPORT SPEED V2 | HIGH | MEDIUM | LOW |

PRINTING APPARATUS

CROSS-REFERENCE TO RELATED APPLICATIONS

This application claims priority to Japanese Patent Application No. 2013-068283 filed on Mar. 28, 2013 and Japanese Patent Application No. 2013-192663 filed on Sep. 18, 2013. The entire disclosure of Japanese Patent Application Nos. 2013-068283 and 2013-192663 is hereby incorporated herein by reference.

BACKGROUND

1. Technical Field

The present invention relates to a printing apparatus which is able to carry out double-sided printing.

2. Related Art

In the prior art, as this type of printing apparatus, there is proposed a printing apparatus which is provided with a pair of transport rollers which are arranged at an upstream side with regard to a head, a pair of discharge rollers which are arranged at a downstream side with regard to the head, and a reversing mechanism which is provided on an upstream side of the transport rollers and which returns a sheet, which is transported from the transport rollers, to the transport rollers by reversing the front and rear of the sheet (for example, refer to Japanese Unexamined Patent Application Publication No. 2007-38562). In this apparatus, when a double-sided printing instruction is given, printing on the front surface is executed so that a sheet transport process where the sheet is transported on a platen which opposes the head is performed by forward rotating the transport rollers and the discharge rollers, and printing on the rear surface is executed so that a sheet returning process where the sheet is transported to the upstream side is performed by reverse rotating the discharge rollers such that a rear edge of the sheet is nipped by the transport rollers, the sheet is transported to the reversing mechanism by reverse rotating the transport rollers in a state where the sheet is nipped, and when the sheet is returned to the transport rollers by reversing the front and rear of the sheet using the reversing mechanism, the sheet is transported again on the platen by forward rotating the transport rollers and the discharge rollers.

In a printing apparatus which executes printing by ejecting ink from a head onto a sheet, there are cases where so-called cockling (a corrugation phenomenon) is generated where the sheet swells due to ink which is ejected from the head. Since it is difficult to transport the sheet and the possibility of a jam being generated increases when cockling is generated, it is desirable that, during the double-sided printing, transporting of the sheet be performed as fast as possible in the sheet returning process and that the sheet be nipped by the transport rollers before cockling is generated. On the other hand, in a printing apparatus which is able to carry out borderless printing where printing is performed such that a margin is not generated on the sheet, concave and convex sections are usually formed on the platen which opposes the head such that the rear surface of the sheet is not soiled by the ink even when borderless printing is executed. In a case where double-sided printing is performed by such a printing apparatus, it is easy for the sheet to be caught on the concave and convex section and there are cases where this catching may cause folding or soiling of the sheet when the rear edge of the sheet is positioned on the platen during the sheet returning process.

SUMMARY

The printing apparatus of the present invention has a main object of suppressing generation of folding and soiling of the sheet during sheet returning in double-sided printing.

The printing apparatus of the present invention adopts the followings in order to achieve the main object described above.

A printing apparatus of a first aspect of the invention is configured to carry out double-sided printing and is provided with a head configured to eject a liquid onto a sheet, a pair of first transport rollers arranged at an upstream side of the head and configured to transport the sheet, a pair of second transport rollers arranged at a downstream side of the head and configured to transport the sheet, a support member configured to support the sheet between the pair of the first transport rollers and the pair of the second transport rollers, and a controller configured to control a double-sided printing operation where printing is carried out on a rear surface of the sheet using a sheet returning process and a reversing process after printing is carried out on a front surface of the sheet. The controller carries out the sheet returning process by reverse rotating the second transport rollers such that the sheet is transported at a first transport speed until a rear edge of the sheet reaches at least the support member and by reverse rotating the second transport rollers such that the sheet is transported at a second transport speed which is faster than the first transport speed when the rear edge of the sheet reaches at least the support member.

The printing apparatus of the aspect of the invention has a support member which supports the sheet between the pair of the first transport rollers and the pair of the second transport rollers, and the sheet returning process when printing on the rear surface of the sheet is carried out by reverse rotating the second transport rollers such that the sheet is transported at the first transport speed until the rear edge of the sheet reaches at least the support member and by reverse rotating the second transport rollers such that the sheet is transported at the second transport speed which is faster than the first transport speed when the rear edge of the sheet reaches at least the support member. Due to this, when the rear edge of the sheet passes the support member, it is possible to suppress generation of folding or soiling of the sheet. In addition, since it is possible to transport the sheet quickly after the rear edge of the sheet reaches at least the support member, it is possible to perform sheet returning before cockling is generated on the front surface of the sheet where liquid is ejected.

In the printing apparatus of another aspect of the invention as above, the controller preferably, in a case where a distance from the rear edge of the sheet to the first transport rollers is less than a predetermined distance when the printing on the front surface of the sheet is completed, starts the sheet returning process once the sheet is transported to the downstream side until the distance from the rear edge of the sheet to the first transport rollers is equal to or more than the predetermined distance. By doing this, it is possible to secure a necessary distance to accelerate the transport speed of the sheet to the second transport speed in the sheet returning process.

In addition, in the printing apparatus of another aspect of the invention which configured to carry out printing by ejecting the liquid while moving the head back and forth in a direction which is orthogonal to a transport direction of the sheet, it is preferable for the controller to set the second transport speed of the sheet in the sheet returning process to be a transport speed which is at least faster than an average transport speed of the sheet which includes transport stopping time when the liquid is being ejected while the head is moving back and forth in a sheet transport process. By doing this, since it is possible to perform the sheet returning process quickly, it is possible to nip the sheet between the first transport rollers before cockling is generated on the front surface of the sheet where liquid is ejected and to shorten the time for executing the double-sided printing.

Furthermore, the printing apparatus of another aspect of the invention is provided with a mode acquiring unit configured to acquire any of a plurality of modes, where it is possible for the controller to set the transport speed of the sheet in the sheet returning process when printing on the rear surface of the sheet to a transport speed according to the mode which is acquired. By doing this, it is possible to more appropriately set the transport speed according to the mode.

In addition, in the printing apparatus of another aspect of the invention, it is preferable that the support member includes a plurality of the support sections arranged in a sub-scanning direction and the controller carries out the sheet returning process by reverse rotating the second transport rollers such that the sheet is transported at the second transport speed when the rear edge of the sheet reaches at least a support section on the side of the pair of second transport rollers.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
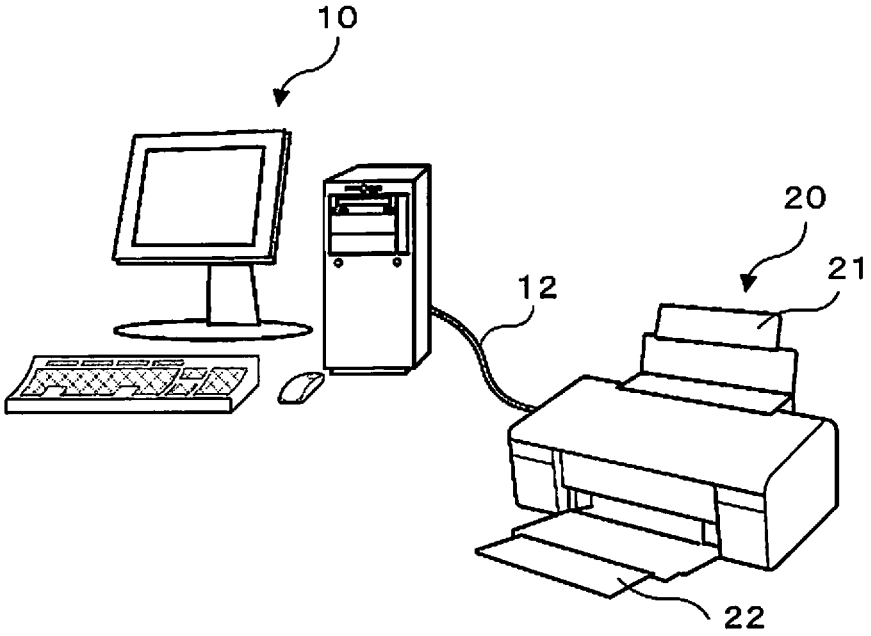
FIG. 1 is a diagram of the external appearance of a printer 20 of the present embodiment.
Figure 2:
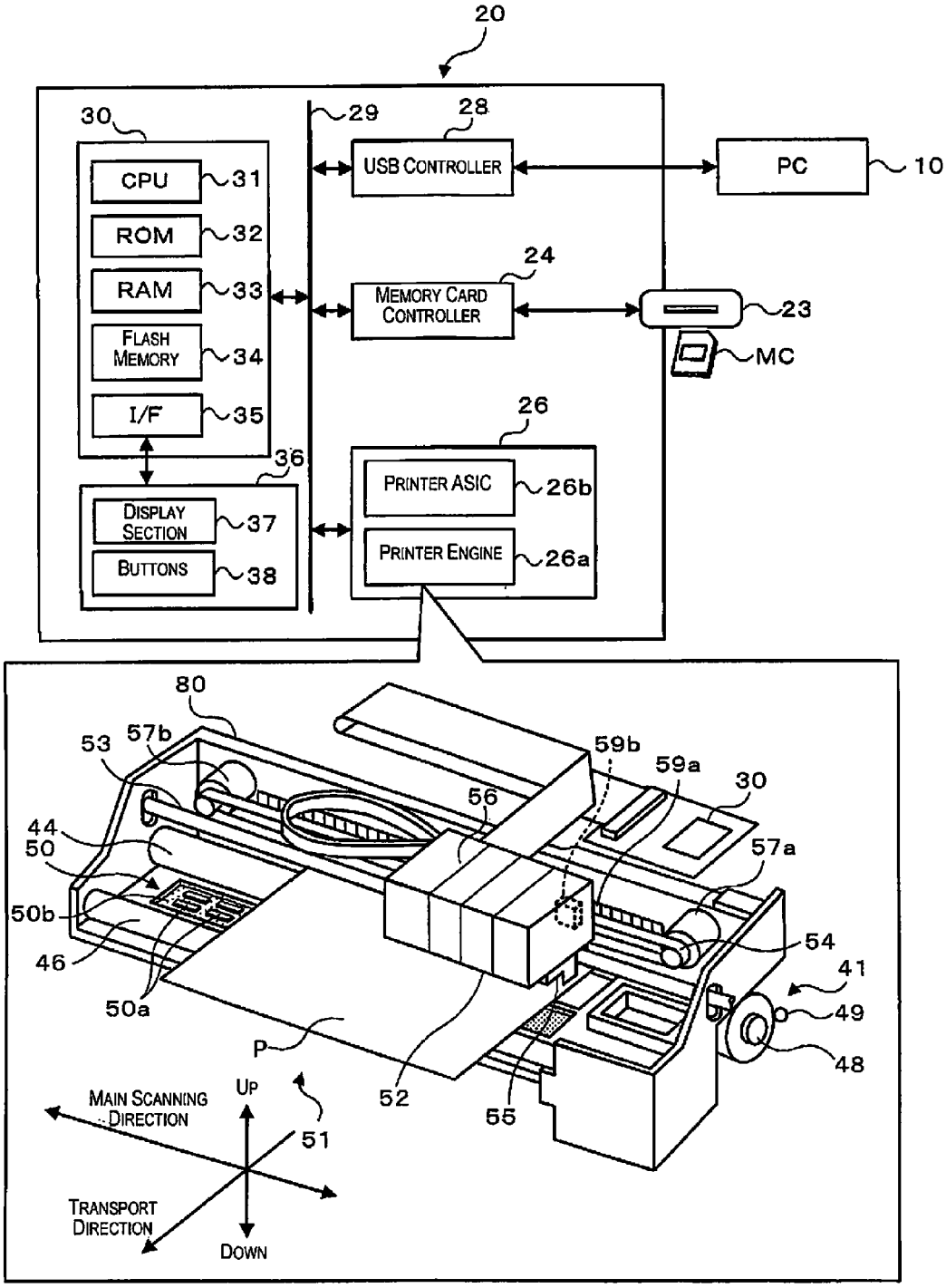
FIG. 2 is a schematic configuration diagram of the printer 20 of the present embodiment.
Figure 3:
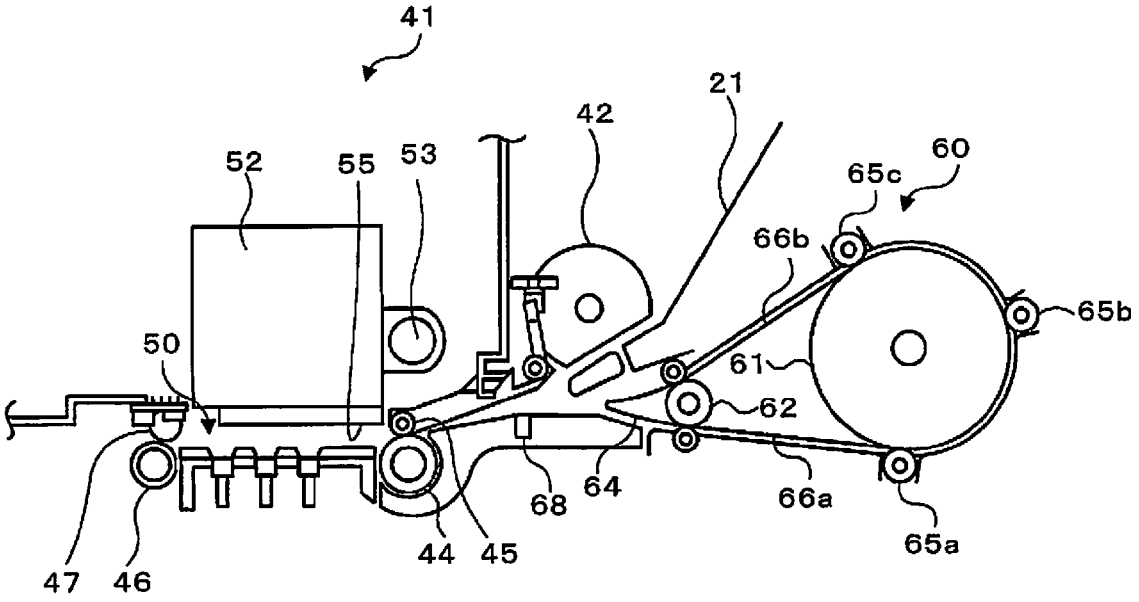
FIG. 3 is a schematic configuration diagram of a sheet transport mechanism 41 and a reversing mechanism 60.

Next, embodiments of the present invention will be described with reference to the drawings. FIG. 1 is an external appearance diagram illustrating the external appearance of a printer 20 which is an embodiment of the present invention, FIG. 2 is a configuration diagram schematically illustrating a configuration of the printer 20 of the present embodiment, and FIG. 3 is a configuration diagram schematically illustrating a configuration of a sheet transport mechanism 41 and a reversing mechanism 60.

As shown in the diagrams, the printer 20 of the present embodiment is configured as an ink jet printer which executes printing by ejecting inks of various colors of cyan (C), magenta (M), yellow (Y), and black (K) (CMYK) based on print data onto a sheet which is transported from a feed tray 21 and discharges the sheet to a discharge tray 22.

This printer 20 includes a printer unit 26 which executes printing, a memory card controller 24 which performs reading and writing of files which store data between memory cards MC which are inserted into a memory card slot 23, a USB controller 28 for performing communication with a computer 10 via a USB cable 12, an operation panel 36 where a menu screen, a print setting screen, or the like is displayed on a display section 37 or where a user inputs instructions which relates to each of the types of print settings, instructions to start printing, or the like via an operation of buttons 38, and a main controller 30 which controls the entire printer.

In addition, the printer 20 is configured such that it is possible for the printer unit 26, the memory card controller 24, the USB controller 28, and the main controller 30 to exchange various types of control signals or data between each other via a bus 29.

The memory card controller 24 performs inputting and outputting of data between memory cards MC which are inserted into the memory card slot 23. When a memory card MC is inserted into the memory card slot 23, the memory card controller 24 transmits image data which is stored on the memory card MC to the main controller 30 by reading out the image data or writes data onto the memory card MC based on commands which are input from the main controller 30.

The printer unit 26 is provided with a printer engine 26*a* and a printer ASIC 26*b* which controls the printer engine 26*a*. As shown in FIG. 2, the printer engine 26*a* is provided with the sheet transport mechanism 41 which transports a sheet P from the rear to the front of the diagram due to driving of a transport roller 44 by a transport motor 48, a head driving mechanism 51 which performs printing by ejecting ink droplets from a print head 55 onto the sheet P which is transported on a platen 50 by the sheet transport mechanism 41, and the reversing mechanism 60 (refer to FIG. 3) which reverses the front and rear of the sheet P during a double-sided printing operation. Here, as shown in FIG. 2, the platen 50 is provided with ribs 50*a* which support the sheet P and a disposal region 50*b* which receives ink which is disposed of due to extending beyond the sheet P such that the rear surface of the sheet P is not soiled during borderless printing. In the platen 50, concave and convex sections are formed on an upper surface by the ribs 50*a* and the disposal region 50*b*.

The head driving mechanism 51 is provided with a carriage motor 57*a* which is arranged on the right side of a mechanical frame 80, a driven roller 57*b* which is arranged on the left side of the mechanical frame 80, a carriage belt 54 which spans between the carriage motor 57*a* and the driven roller 57*b*, a carriage 52 which is moved back and forth to the left and right along a guide 53 by the carriage belt 54 to accompany driving of the carriage motor 57*a*, ink cartridges 56 which are mounted in the carriage 52 and which individually store inks of various colors of yellow (Y), magenta (M), cyan (C), and black (K) which contain dyes or pigments which are coloring agents in water which is a solvent, and the print head 55 which receives a supply of ink from the ink cartridges 56 and ejects ink droplets by pressure being applied to the ink using a piezoelectric element.

Here, an optical scale 59*a* and an optical sensor 59*b*, which is formed of a light emitting element (for example, a light emitting diode or the like) and a light receiving element (for example, a phototransistor or the like) so as to oppose the optical scale 59*a* on the rear surface of the carriage 52, are each attached to the mechanical frame 80 along the moving direction of the carriage 52, and it is possible to detect the position of the carriage 52 in the left and right direction (the main scanning direction) by receiving light which is emitted from the light emitting element of the optical sensor 59*b* toward the optical scale 59*a* using the light receiving element.

As shown in FIG. 3, the sheet transport mechanism 41 is provided with a feed roller 42 which feeds the sheet P which is set on the feed tray 21 which is the supply end of the sheet P, a transport roller 44 which transports the sheet P which is fed by the feed roller 42 onto the platen 50 which opposes the print head 55, a discharge roller 46 which discharges the sheet P to the discharge tray 22 which is the discharge end, and the transport motor 48 which rotates and drives the feed roller 42, the transport roller 44, and the discharge roller 46. Here, the transport roller 44 and the discharge roller 46 respectively abut with driven rollers 45 and 47 and the sheet P is transported in a state of being interposed between the rollers (in a nipped state). A rotation angle sensor 49 which detects the rotation angle of the transport motor 48 is attached to the rotation shaft of the transport motor 48, and driving control is carried out based on the rotation angle from the rotation angle sensor 49. In addition, a sheet detecting sensor 68 for detecting the rear edge of the sheet P is provided between the feed roller 42 and the transport roller 44.

The reversing mechanism 60 is configured as a mechanism which receives the sheet P, which is transported from the transport roller 44 in the opposite direction to the transport direction (the sheet transporting direction) during printing, from the rear edge side and which feeds out the sheet P to the transport roller 44 with the rear edge side of the sheet P as the front end side after reversing the front and rear. The reversing mechanism 60 is provided with a reversing roller 61 which transports the sheet P along an outer circumferential surface, a sheet transport roller 62 which transports the sheet P which is transported from the transport roller 44 side along a transport path 66*a* to the reversing roller 61 side and which transports the sheet P which is transported from the reversing roller 61 side along a transport path 66*b* to the transport roller 44 side, a guide member 64 for smoothly performing receiving of the sheet P from the transport roller 44 side to the reversing roller 61 side and feeding out of the sheet P from the reversing roller 61 side to the transport roller 44 side, and guiding rollers 65*a*, 65*b*, and 65*c* which each abut with the reversing roller 61 and which are for transporting the sheet P along the outer circumferential surface of the reversing roller 61. The reversing roller 61 and the sheet transport roller 62 rotate counterclockwise in FIG. 3 by being driven by a driving motor which is not shown in the diagram. In addition, the guiding rollers 65*a*, 65*b*, and 65*c* are driven to rotate clockwise to accompany the counterclockwise rotation of the reversing roller 61.

As shown in FIG. 2, the main controller 30 is configured as a microprocessor with a CPU 31 as its center, and is provided with a ROM 32 which stores various types of processing programs, a RAM 33 which temporarily stores data or saves data, a flash memory 34 where it is possible to write and erase data, and an interface (I/F) 35. An image file is input from the memory card MC which is inserted in the memory card slot 23 to the main controller 30 via the memory card controller 24. In addition, data received from the computer 10 may be input via the USB controller 28. In addition, command signals from the buttons 38 of the operation panel 36 may be input via the I/F 35. Furthermore, detection signals from various types of sensors (for example, the optical sensor 59*b* which detects the position of the carriage 52, the rotation angle sensor 49 which detects the rotation angle of the transport motor 48, the sheet detecting sensor 68 which detects the rear edge of the sheet P, and the like) which detect a driving state of the printer engine 26*a* may be input via the printer ASIC 26*b*.

In addition, from the main controller 30, transmission data to be transmitted to the computer 10 is output to the USB controller 28, a control signal is output to the display section 37 of the operation panel 36 via the I/F 35, and a driving command of the printer engine 26*a* is output to the printer ASIC 26*b*. In addition, the RAM 33 is provided with a print buffer region, and print data which is sent from the computer 10 via the USB controller 28 is stored in the print buffer region.

Figure 4:
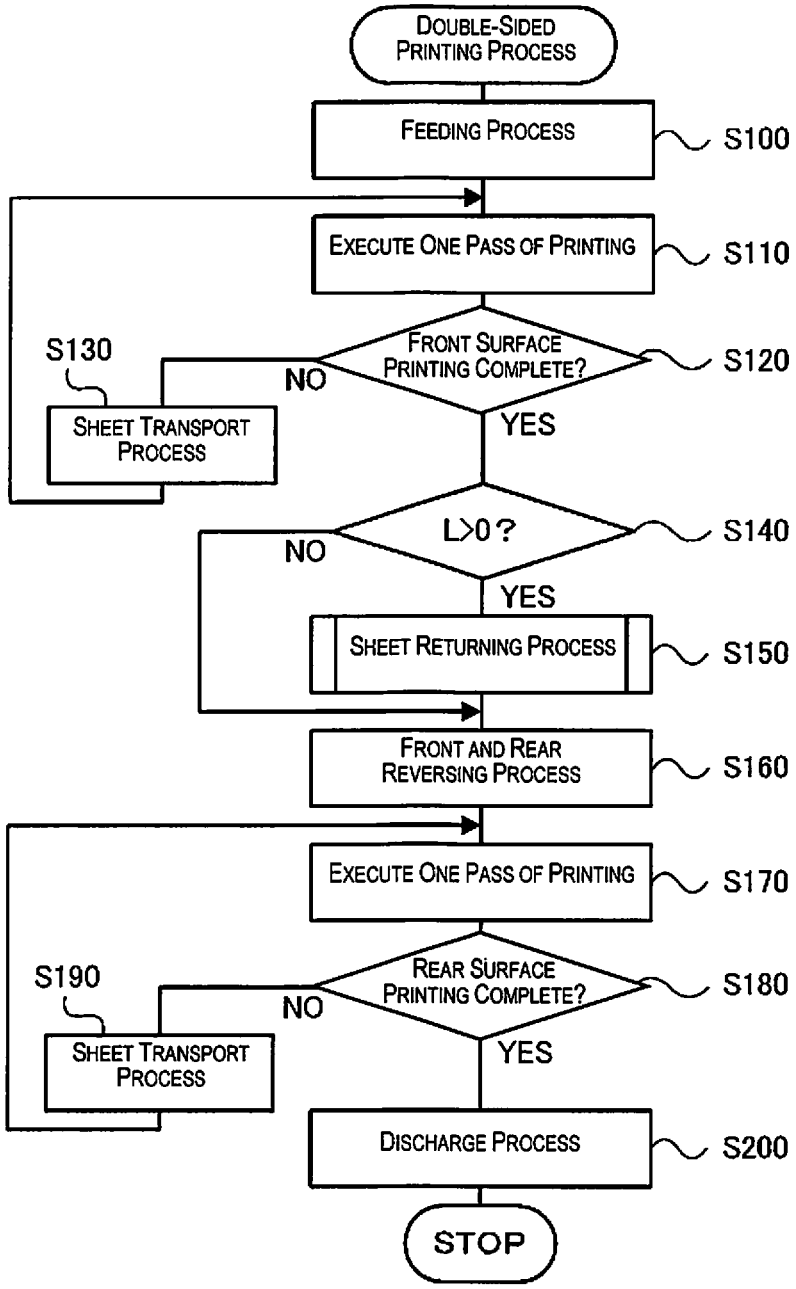
FIG. 4 is a flow chart illustrating an example of a double-sided printing process.

The operation of the printer 20 of the present embodiment configured in this manner, in particular, the operation during double-sided printing, will be described. FIG. 4 is a flow chart illustrating an example of a double-sided printing process which is executed by the CPU 31 of the main controller 30. This process is executed in cases where print jobs which include print settings and print data are received from the computer 10 or where an instruction to start printing is given by selecting an image to be printed from the memory card MC which is inserted in the memory card slot 23 and selecting the print settings.

When the double-sided printing is executed, the CPU 31 of the main controller 30 firstly executes a feed process where the sheet P which is set in the feed tray 21 is transported on the platen 50 by driving and controlling the transport motor 48 (step S100) and executes one pass of printing with regard to the front surface of the sheet P which is transported (step S110). Then, it is determined whether or not there is print data to be printed in the next pass (step S120), the sheet P is transported a predetermined amount if it is determined that there is print data to be printed in the next pass (step S130), and the process, where the next one pass of printing is carried out, is repeated by returning to step S110.

It is determined that printing on the front surface of the sheet P is completed if it is determined that there is no print data to be printed in the next pass, and next, it is determined whether or not a distance L from the rear edge of the sheet P to the transport roller 44 is a value which is larger than 0 (step S140). Here, it is possible to calculate the distance L by, for example, calculating the distance from the rear edge of the sheet P to the sheet detecting sensor 68 based on the amount which the sheet P is transported (the transport amount of the sheet P) by the transport roller 44 since the detection of the rear edge of the sheet P by the sheet detecting sensor 68 and reducing the distance between the sheet detecting sensor 68 and the transport roller 44 which is determined in advance by the distance which is calculated. Here, it is possible for the transport amount of the sheet P to be calculated by adding the rotation angle which is detected by the rotation angle sensor 49. When it is determined that the distance L is a value which is larger than 0, a sheet returning process, where the sheet P is transported to the upstream side until the sheet P is nipped by the transport roller 44, is executed (step S150), and a front and rear reversing process, where the front and rear of the sheet P are reversed, is executed (step S160). On the other hand, when it is determined that the distance L is a value which is equal to or less than 0, the front and rear reversing process is executed (step S160) without performing the sheet returning process since the rear edge of the sheet P is already nipped by the transport roller 44. Here, the sheet returning process is performed by executing the sheet returning process in FIG. 5 which will be described later. In addition, the front and rear reversing process is performed by transporting the sheet P to the reversing mechanism 60 by reverse rotating and driving the transport roller 44 using the transport motor 48, feeding out the sheet P which is transported from the transport roller 44 side to the transport roller 44 side by reversing the front and rear of the sheet P by rotating and driving the reversing roller 61 and the sheet transport roller 62 using a driving motor which is not shown in the diagram, and transporting the sheet P which is sent out from the reversing mechanism 60 on the platen 50 again by forward rotating and driving the transport roller 44 using the transport motor 48.

When the front and rear of sheet P are reversed in this manner, one pass of printing is executed with regard to the rear surface of the sheet P (step S170). Then, it is determined whether or not there is print data to be printed in the next pass (step S180), and when it is determined that there is print data to be printed in the next pass, the sheet P is transported a predetermined amount (step S190), and the process, where the next one pass of printing is carried out, is repeated by returning to step S170. On the other hand, it is determined that printing on the rear surface of the sheet P is completed when it is determined that there is no print data to be printed in the next pass, and the double-sided printing process is finished by executing a discharge process where the sheet P is discharged to the discharge tray 22 (step S200) by driving and controlling the transport motor 48.

Figures 5, 6:
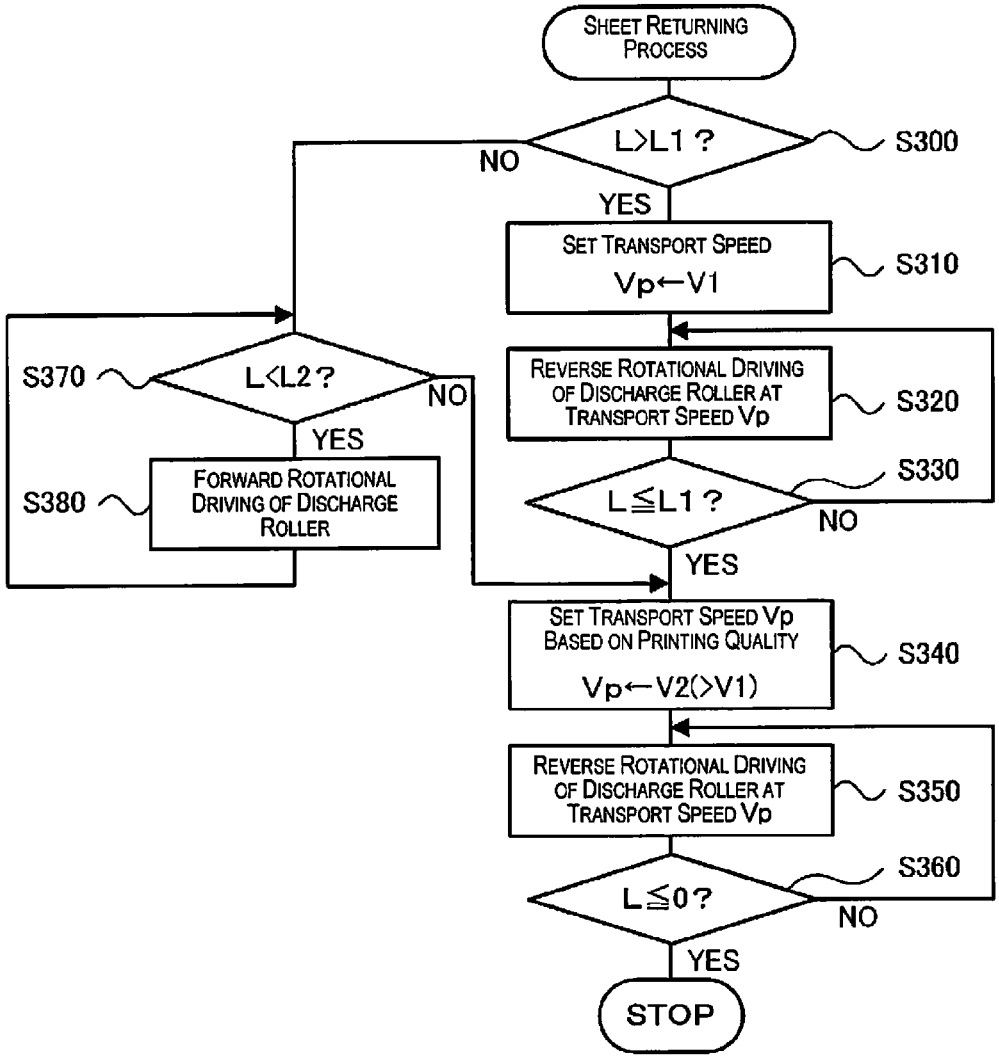
FIG. 5 is a flow chart illustrating an example of a sheet returning process.
FIG. 6 is an explanatory diagram illustrating a relationship between printing quality and a second transport speed V2.

Next, the sheet returning process in FIG. 5 will be described. In the sheet returning process, firstly, it is determined whether or not the distance L from the rear edge of the sheet P to the transport roller 44 is longer than a predetermined distance L1 when printing on the front surface is complete (step S300). Here, the predetermined distance L1 is determined in advance as the distance from a predetermined position on the rear edge of the platen 50 in the transport direction to the transport roller 44. Accordingly, the process of step S300 is a process where it is determined whether or not the rear edge of the sheet P is on the platen 50. When it is determined the distance L is longer than the predetermined distance L1, a transport speed Vp is set to a first transport speed V1 (step S310), and driving control of the transport motor 48 is carried out such that the sheet P is transported to the upstream side at the transport speed Vp which is set until the distance L is equal to or less than the predetermined distance L1 (steps S320 and S330). When the distance L is equal to or less than the predetermined distance L1, the transport speed Vp is set to a second transport speed V2 according to the print quality which is included in the print settings (step S340), and the sheet returning process is finished by carrying out driving control of the transport motor 48 such that the sheet P is transported to the upstream side at the transport speed Vp which is set until the distance L is a value of 0 or less, that is, until the rear edge of the sheet P reaches the transport roller 44 (step S350 and S360). Here, the second transport speed V2 is set as a speed which is equal to or more than the transport speed in the sheet transport process in step S130. In the present embodiment, assuming that there is a mode acquiring unit, a relationship between printing qualities ("high quality", "standard", "fast", and the like) which are included in the printing settings and the second transport speed V2 is stored in the ROM 32 as a table which is determined in advance, and when the printing qualities (modes) are given, the corresponding second transport speed V2 is derived from the table and set as the transport speed Vp. An example of the table is shown in FIG. 6. As shown in the diagram, in a case where the printing quality is "fast", the second transport speed V2 is set to be faster than in the case of "standard", and in a case where the printing quality is "standard", the second transport speed V2 is set to be faster than in the case of "high quality". In addition, the second transport speed V2 is the slowest in a case where the printing quality is "high quality", but even in this case, the second transport speed V2 is set to a speed which is faster than the first transport speed V1.

In addition, assuming that the transport speed Vs is the average speed of the sheet transporting or the maximum speed during printing, the second transport speed V2 is set to a speed which is faster than the transport speed Vs in the present embodiment.

Figure 7:
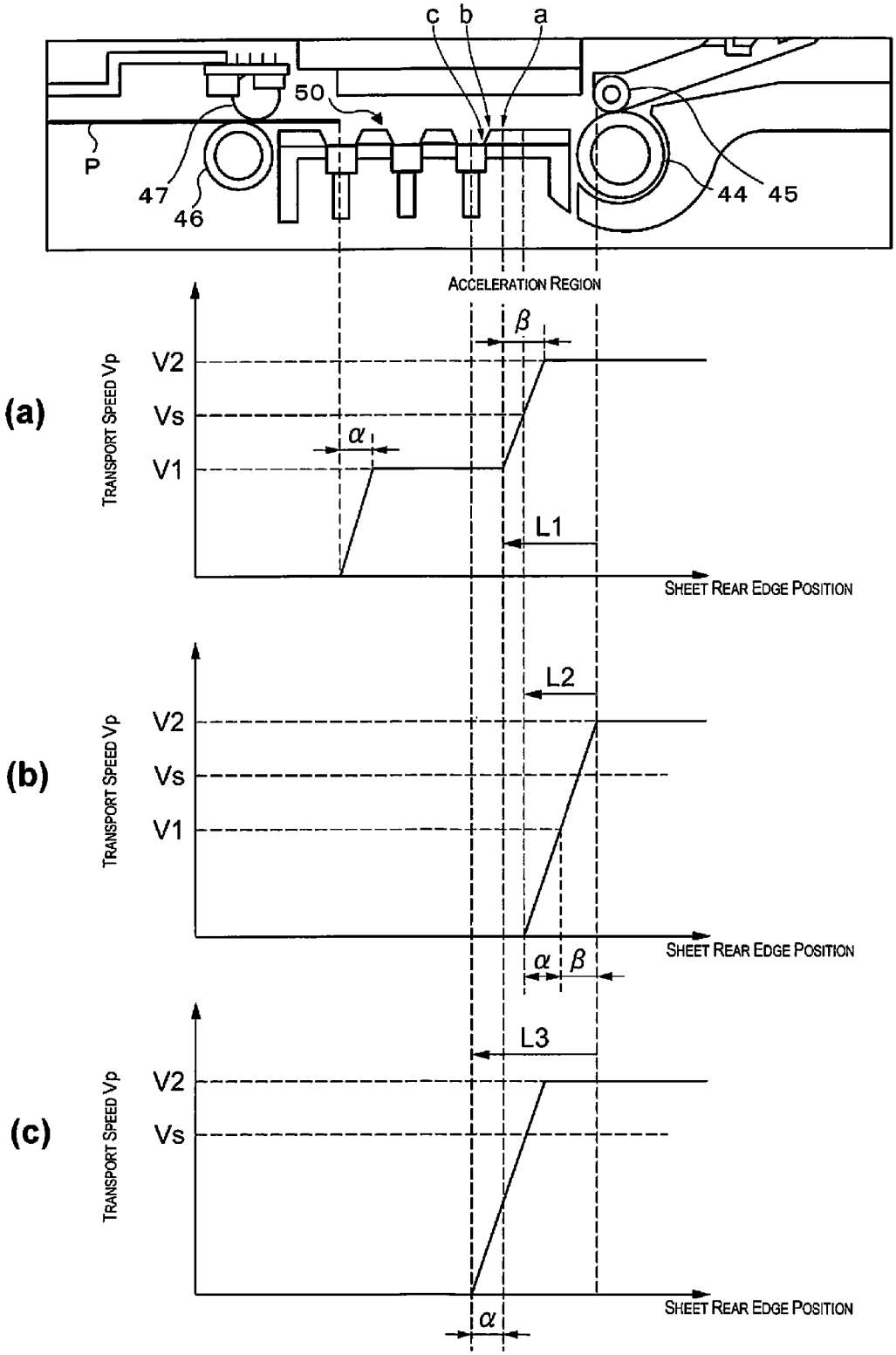
FIG. 7 is an explanatory diagram illustrating a relationship between a position of a rear edge of a sheet and a transport speed Vp.

Here, FIG. 7 is explanatory diagrams illustrating the relationship between a sheet rear edge position Pp and the transport speed Vp. As shown in (a) of FIG. 7, in a case where the sheet rear edge position is on the platen 50, that is, in a case where the distance L from the sheet rear edge position to the transport roller 44 is sufficiently longer than the predetermined distance L1, the sheet P is transported to the upstream side at the first transport speed V1 which is a low speed, and in a case where the sheet rear edge position is a position which passed through the platen 50, that is, when the distance L is less than or equal to the predetermined distance L1, the transport speed Vp of the sheet P is accelerated from the first transport speed V1 to the second transport speed V2, and the second transport speed V2 is maintained until the rear edge of the sheet P is nipped by the transport roller 44. Due to this, when the rear edge of the sheet P passes the platen 50, it is possible to smoothly transport the sheet P without the sheet P being caught on the concave and convex section of the platen 50 and, when the rear edge of the sheet P passes the platen 50, it is possible to transport the sheet P quickly to the transport roller 44.

In the present embodiment, the predetermined distance L1 adopts the distance in the transport direction with the position of the transport roller 44 as a starting point and a predetermined position a on the platen 50 as a finishing point. When an interval in the transport direction between one end section b and another end section c on one inclined surface (taper) on the upstream side of the concave and convex section which is formed on the furthest upstream side on the platen 50 is set as a distance LT (which is omitted from the diagrams), the predetermined position a is a position which is separated from the one end section b by the distance LT at the upstream side.

By setting the end point which defines the predetermined distance L1 as the predetermined position a on the platen 50, it is possible to prevent the possibility of the sheet P being caught by the taper even with the platen 50 where the concave and convex section are formed to be shifted to the upstream side due to a shaping error or the like. Here, the end point which defines the predetermined distance L1 is not limited to the predetermined position a, and it is possible to conceive of aspects where the one end section b or the other end section c is set as the end point.

For example, in a case where the other end section c is set as the end point, the predetermined distance L1 which is defined by the position of the transport roller 44 and the other end section c increases by an amount which is double the distance LT compared to a case of being defined by the predetermined position a, but it is possible to start switching from the transport speed V1 to the transport speed V2 at an earlier stage while preventing the possibility that the sheet P will be caught by the taper.

In addition, in a case where the one end section b is set as the end point, the predetermined distance L1 which is defined by the position of the transport roller 44 and the one end section b increases by an amount which is the distance LT compared to a case of being defined by the predetermined position a, but the possibility that the sheet P will be caught by the taper is prevented even more than a case of being defined by the other end section c and it is possible to start the switching process from the transport speed V1 to the transport speed V2 at an earlier stage than the predetermined position a.

Here, in the present embodiment, the distance which the sheet P is transported from starting of transporting of the sheet P until the transport speed Vp of the sheet P reaches the transport speed V1 is set as $\alpha$, and the distance which the sheet P is transported until the transport speed Vp of the sheet P reaches the transport speed V2 after accelerating from the transport speed V1 is set as β.

Next, when it is determined that the distance L from the rear edge of the sheet P to the transport roller 44 is equal to or less than the predetermined distance L1 when the front surface printing is complete in step S300, that is, that the rear edge of the sheet P is already passed over the platen 50, furthermore, it is determined whether or not the distance L is less than a predetermined distance L2 (step S370). Here, as shown in (b) of FIG. 7, the predetermined distance L2 is the distance (α+β) which the sheet P is transported in a case where the transport speed Vp of the sheet P accelerates from a stationary state to the second transport speed V2.

When it is determined that the distance L is equal to or more than the predetermined distance L2, the flow proceeds to step S340, and the sheet returning process is finished by carrying out driving control of the transport motor 48 such that the second transport speed V2 is set as the transport speed Vp and the sheet P is transported to the upstream side at the transport speed Vp which is set until the distance L is a value of 0 (step S340 to S360). In this case, after the transport speed Vp accelerates to the transport speed V1, the acceleration continues to the transport speed V2, and the transport speed Vp reaches the transport speed V2 at the position which is the starting point.

On the other hand, when it is determined that the distance L is less than the predetermined distance L2, the discharge rollers 46 rotate forward such that the sheet P is transported to the downstream side due to driving control of the transport motor 48 until the distance L is equal to or more than the predetermined distance L2 (step S370 and S380), and the flow proceeds to step S340. In this manner, in a case where the distance L from the rear edge of the sheet P to the transport roller 44 is less than the distance L2, the distance for accelerating the sheet P to the second transport speed V2 during sheet returning is secured by the sheet P being separated from the transport roller 44 until the distance L is equal to or more than the distance L2.

In addition, it is possible to conceive of a case where the distance L from the sheet rear edge position to the transport roller 44 is longer than the predetermined distance L1 by a predetermined distance. For example, as shown in (c) of FIG. 7, a case is considered where the distance L is a predetermined distance L3 where the distance a is added to the predetermined distance L1.

In this case, the transport speed Vp is accelerated by starting transporting of the sheet P, but the rear edge of the sheet P enters inside the predetermined distance L1 at a point in time when the sheet P has moved passed by the distance a during the acceleration. Accordingly, since there is no possibility that the rear edge of the sheet P will be caught on the concave and convex section of the platen 50, the target transport speed Vp is set to the transport speed V2 from the time of starting transport. Due to this, it is possible to rapidly transport the sheet P to the transport roller 44.

Here, the corresponding relationship between the constituent components of the present embodiment and the constituent components of the present invention will be clarified. The print head 55 of the present embodiment is equivalent to the "head" of the present invention, the platen 50 is equivalent to the "concave and convex section", the transport roller 44 and the driven roller 45 are equivalent to the "first transport rollers", the discharge roller 46 and the driven roller 47 are equivalent to the "second transport rollers", the reversing mechanism 60 is equivalent to the "reversing mechanism", and the CPU 31 of the main controller 30 which executes the double-sided printing process of FIG. 4 and the sheet returning process of FIG. 5 is equivalent to the "transport control means during the double-sided printing".

According to the printer 20 of the present embodiment described above, since the sheet P is transported at the first transport speed V1 when the rear edge of the sheet P is on the platen 50 during transporting of the sheet P to the reversing mechanism 60 according to the sheet returning process after completing printing on the front surface and the sheet P is transported at the second transport speed V2 which is faster than the first transport speed V1 when the rear edge of the sheet P passes over the platen 50 until the rear edge of the sheet P is nipped by the transport roller 44, it is possible to smoothly transport the sheet P without the rear edge of the sheet P being caught on the concave and convex section of the platen 50 and it is possible to transport the sheet P quickly to the transport roller 44 when the rear edge of the sheet P passes the platen 50. As a result, it is possible to suppress generation of folding or soiling of the sheet due to the sheet catching on the concave and convex section of the platen 50 and it is possible to nip the sheet P in the transport roller 44 before cockling is generated on the front surface of the sheet where ink is ejected.

In addition, according to the printer 20 of the present embodiment, since the transport speed Vp (the second transport speed V2) after the sheet P passes over the platen 50 is set based on the printing settings (the printing quality), it is possible to smoothly transport the sheet P to the reversing mechanism 60 at a transport speed which is suitable for the printing settings.

Furthermore, according to the printer 20 of the present embodiment, in a case where the distance L from the rear edge of the sheet P to the transport roller 44 when the surface printing is completed is less than the predetermined distance L2 which is necessary to accelerate the sheet P from a stationary state to the second transport speed V2, it is possible to transport the sheet P when the sheet returning is performed by accelerating the sheet P to the second transport speed V2 since the sheet returning is performed when the sheet P is separated from the transport roller 44 such that the distance L is equal to or more than the predetermined distance L2.

Here, the transport roller 44 in combination with the driven roller 45 and the discharge roller 46 in combination with the driven roller 47 are configured in the present embodiment such that the sheet P is fed in an inclined direction with regard to the surface of the platen 50 when transporting the sheet P. That is, as shown in FIG. 7, the transport roller 44 in combination with the driven roller 45 and the discharge roller 46 in combination with the driven roller 47 are arranged so that a line which is orthogonal with regard to a line which joins the centers of each of the rollers in the abutting sections of each of the rollers is inclined with regard to the surface of the platen 50, and the sheet P is transported in a state of being pressed against the platen 50 (the ribs 50*a*). Due to this, it is possible to preserve a constant gap (an interval) between the print head 55 and the sheet P and it is possible to attain a more favorable printing quality.

Here, the present invention is not limited to any of the embodiments described above and may be realized in various aspects which belong to the technical scope of the present invention.

For example, in the embodiments described above, the second transport speed V2 in the sheet returning process is determined based on the printing quality, but the present invention is not limited to this, and the second transport speed V2 may be determined based on other parameters such as the type of the sheet or the size of the sheet.

In addition, in the embodiments described above, the second transport speed V2 in the sheet returning process is variable, but the present invention is not limited to this and the second transport speed V2 may be fixed.

In addition, in the embodiments described above, the second transport speed V2 in the sheet returning process is set to a speed which is equal to or more than the transport speed of the sheet P in the sheet transport process (the process in step S130 of the double-sided printing process) which is executed after one pass of printing, but the present invention is not limited to this, and the second transport speed V2 may be set to a speed which is equal to or more than the average transport speed of the sheet transport process which includes the time during printing when the sheet transporting is stopped.

In addition, in the embodiments described above, in a case where the distance L from the rear edge of the sheet P to the transport roller 44 when the front surface printing is complete is less than the predetermined distance L2 which is necessary to accelerate the sheet P from a stationary state to the second transport speed V2, the sheet P is separated from the transport roller 44 such that the distance L is equal to or more than the predetermined distance L2, but the present invention is not limited to this, and it does not matter if the sheet P is transported to the reversing mechanism 60 directly even in a case where the distance L is less than the predetermined distance L2.

In addition, in the embodiments described above, the sheet P is transported at the first transport speed V1 when the rear edge of the sheet P is on the platen 50 and the transport speed of the sheet P is switched from the first transport speed V1 to the fast second transport speed V2 once the rear edge of the sheet P passes over the platen 50, but the present invention is not limited to this. The transport speed of the sheet P may be switched from the first transport speed V1 to the second transport speed V2 when the rear edge of the sheet P reaches a predetermined position (for example, on the ribs 50*a*) which is before the rear edge of the sheet P passes over the platen 50. For example, in a case where a plurality of the ribs 50*a* (the support section) are lined up in the transport direction (the sub-scanning direction) of the sheet P, the transport speed of the sheet P may be switched from the first transport speed V1 to the second transport speed V2 when the rear edge of the sheet P reaches above the ribs 50*a* on the discharge rollers 46 side, or the transport speed of the sheet P may be switched from the first transport speed V1 to the second transport speed V2 when the rear edge of the sheet P reaches above the ribs 50*a* on the transport roller 44 side. That is, it is sufficient if the transport speed of the sheet P is switched from the first transport speed V1 to the second transport speed V2 when the rear edge of the sheet P reaches at least above the ribs 50*a* on the discharge rollers 46 side.

In the embodiments described above, the print head 55 is a format where a voltage is applied to a piezoelectric element and pressure is applied to the ink by the shape of the piezoelectric element changing, but a format may be adopted where pressure is applied to the ink using bubbles which are generated by heating the ink by applying a voltage to a heating resistor (for example, a heater, or the like). In addition, the embodiments described above are so-called on-carriage configurations where the ink cartridge 56 is mounted in the carriage 52 which moves back and forth, but there may be a so-called off-carriage configuration where the ink cartridge is mounted in the mechanical frame 80 and ink is supplied from the ink cartridge to the print head 55 via a tube.

In the embodiments described above, the printer 20 is a so-called serial type ink jet printer where the print head 55 moves back and forth in a direction which is orthogonal with regard to the transport direction of the sheet, but the present invention is not limited to this, and the printer 20 may be a so-called line type ink jet printer where the print head is fixed and does not move back and forth and nozzles are formed in lines in the print head so as to cover the entire sheet width

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing apparatus configured to carry out double-sided printing, the printing apparatus comprising:

a head configured to eject a liquid onto a sheet;

a pair of first transport rollers arranged at an upstream side of the head and configured to transport the sheet;

a pair of second transport rollers arranged at a downstream side of the head and configured to transport the sheet;

a support member configured to support the sheet between the pair of the first transport rollers and the pair of the second transport rollers; and a controller configured to control a double-sided printing operation where printing is carried out on a rear surface of the sheet using a sheet returning process and a reversing process after printing is carried out on a front surface of the sheet, the controller carrying out the sheet returning process by reverse rotating the second transport rollers such that the sheet is transported at a first transport speed until a rear edge of the sheet reaches at least the support member, and by reverse rotating the second transport rollers such that the sheet is transported at a second transport speed which is faster than the first transport speed after the rear edge of the sheet reaches at least the support member and prior to the sheet reaching the first transport rollers arranged at the upstream side.

2. The printing apparatus according to claim 1, wherein the controller, in a case where a distance from the rear edge of the sheet to the first transport rollers is less than a predetermined distance when the printing on the front surface of the sheet is completed, starts the sheet returning process once the sheet is transported to the downstream side until the distance from the rear edge of the sheet to the first transport rollers is equal to or more than the predetermined distance.

3. The printing apparatus according to claim 2, wherein the printing apparatus is configured to carry out printing by ejecting the liquid while moving the head back and forth in a direction which is orthogonal to a transport direction of the sheet, and the controller sets the second transport speed of the sheet in the sheet returning process to be a transport speed which is at least faster than an average transport speed of the sheet which includes transport stopping time when the liquid is being ejected while the head is moving back and forth in a sheet transport process.

4. The printing apparatus according to claim 3, further comprising:

a mode acquiring unit configured to acquire any of a plurality of modes, wherein the controller sets the transport speed of the sheet in the sheet returning process when printing on the rear surface of the sheet to a transport speed according to a mode which is acquired.

5. The printing apparatus according to claim 4, wherein the support member includes a plurality of support sections arranged in a sub-scanning direction, and the controller carries out the sheet returning process by reverse rotating the second transport rollers such that the sheet is transported at the second transport speed when the rear edge of the sheet reaches at least a support section on the side of the pair of the second transport rollers.

* * * * *